US006408819B1

(12) United States Patent
Mezger et al.

(10) Patent No.: US 6,408,819 B1
(45) Date of Patent: Jun. 25, 2002

(54) METHOD FOR CONTROLLING AND REGULATING COMBUSTION IN THE COMBUSTION CHAMBER OF AN INTERNAL COMBUSTION ENGINE

(75) Inventors: Manfred Mezger, Markgroeningen; Hubert Bischof, Vaihingen/Enz, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/508,070

(22) PCT Filed: Aug. 24, 1998

(86) PCT No.: PCT/DE98/02471

§ 371 (c)(1),
(2), (4) Date: Mar. 6, 2000

(87) PCT Pub. No.: WO99/13217

PCT Pub. Date: Mar. 18, 1999

(30) Foreign Application Priority Data

Sep. 6, 1997 (DE) ..... 197 39 085

(51) Int. Cl.[7] ..... F02P 5/00
(52) U.S. Cl. ..... 123/406.29; 123/406.41
(58) Field of Search ..... 123/406.29, 406.34, 123/406.35, 406.41; 73/35.01, 35.03, 35.04

(56) References Cited

U.S. PATENT DOCUMENTS

| | | | | | |
|---|---|---|---|---|---|
| 4,211,194 | A | | 7/1980 | Goto et al. | 123/417 |
| 4,269,155 | A | * | 5/1981 | Iwata et al. | 123/425 |
| 4,513,717 | A | * | 4/1985 | Kobayashi | 123/425 |
| 4,565,087 | A | * | 1/1986 | Damson et al. | 73/35 |
| 4,770,144 | A | * | 9/1988 | Sakakibara et al. | 123/425 |
| 5,069,183 | A | | 12/1991 | Nagano et al. | 123/419 |
| 5,088,044 | A | * | 2/1992 | Matsuura | 123/406.35 |
| 5,402,675 | A | * | 4/1995 | Entenmann et al. | 73/117.3 |

FOREIGN PATENT DOCUMENTS

| | | |
|---|---|---|
| DE | 39 33 947 | 1/1991 |
| DE | 43 41 796 | 9/1995 |

* cited by examiner

*Primary Examiner*—Henry C. Yuen
*Assistant Examiner*—Mahmoud Gimie
(74) *Attorney, Agent, or Firm*—Kenyon & Kenyon

(57) ABSTRACT

A method for controlling and regulating the combustion in the combustion chamber of an internal combustion engine, at least one knock sensor detecting a cylinder-specific knocking signal for each cylinder of the internal combustion engine, the knocking signal detected in this manner being fed to an evaluation circuit which reconstructs the combustion chamber pressure characteristic from the detected knocking signal, this combustion chamber pressure characteristic being evaluated for the control and regulation of the next combustion in this cylinder.

5 Claims, 1 Drawing Sheet

METHOD FOR CONTROLLING AND REGULATING COMBUSTION IN THE COMBUSTION CHAMBER OF AN INTERNAL COMBUSTION ENGINE

BACKGROUND INFORMATION

German Patent No. 43 41 796 describes, a pressure sensor arranged in each combustion chamber of the internal combustion engine so that the pressure in the combustion chamber can be detected during a predefinable period of time. In this context, the pressure values during the compression stroke are stored until a predefinable crank angle is reached, and, subsequent to passing the predefinable crank angle, are output again in reversed manner during identical periods of time, allowing a subtraction operation to be performed on the pressure values which continue to be detected during the combustion and the output pressure values detected during the compression stroke. The integral of the determined difference and the appertaining crank angle, at which a predefinable surface portion of the integral is reached, form the bases for determining the deviation of an ascertained crank angle from a predefinable setpoint crank angle, so that, on the basis of the determined deviation, the combustion position (angle) can be regulated.

Furthermore, methods are known in which, for recognizing the specific power stroke, a pressure sensor is arranged in the combustion chamber, and, when a threshold value is exceeded by the sensor signals, it is concluded that the cylinder in question is in the expansion stroke. Moreover, it is known to provide a knock sensor for recognizing the specific power stroke, the sensor signal being compared with a threshold value as well, it being concluded that, when the threshold value is exceeded, the cylinder in question is in its expansion stroke.

SUMMARY OF THE INVENTION

The method according to the present invention has the advantage over the known methods that no pressure sensor is provided in the combustion chamber, thus avoiding additional bores in the cylinder head. Moreover, by reconstructing the combustion chamber pressure characteristic from the signal of the knock sensor, it is possible to determine different operating quantities of the internal combustion engine without additional sensors. In this method, consequently, the already existing sensors can be used to regulate different parameters.

It is particularly advantageous that, on the basis of the reconstructed combustion chamber pressure characteristic, an irregular running recognition as well as a misfiring recognition, a determination of the combustion position, and a determination of the phase angle is possible. Consequently, no change needs to be made on the part of the design but the method can be provided simply by adapting the program flow in the control unit accordingly.

DETAILED DESCRIPTION

Figure 1:
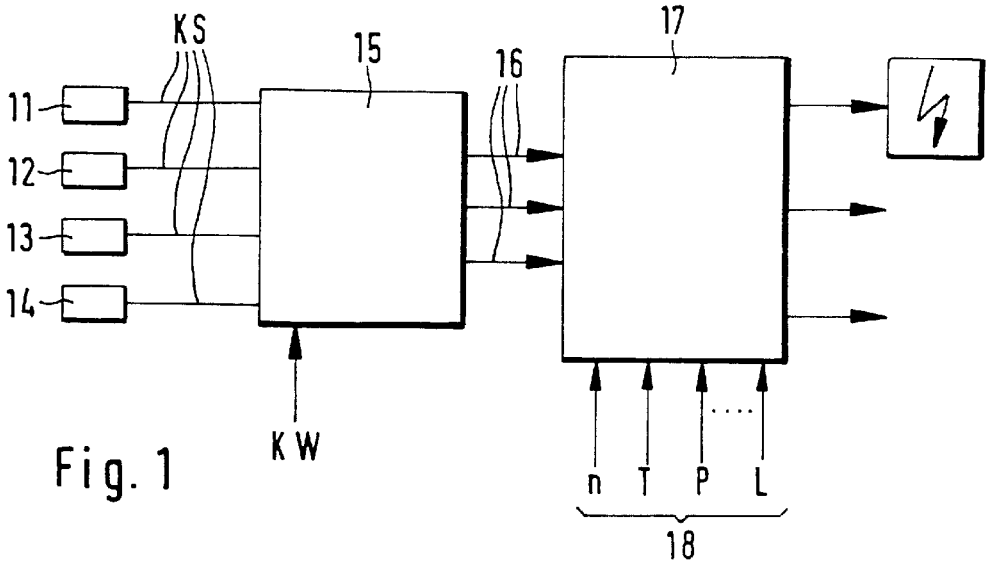
FIG. 1 shows the design of an evaluation unit with control unit for internal combustion engines.

FIG. 1 shows the schematic design of an ignition system having knock sensors and an evaluation unit. In the device shown, four knock sensors 11 through 14 are each allocated to an individual cylinder, which is not shown here. Knocking signal KS acquired by each knock sensor 11 through 14 is fed to an evaluation unit 15 arranged downstream. Crankshaft signal KW is also fed to evaluation unit 15 In evaluation unit 15, the cylinder-specific knock sensor signal is now conditioned with the assistance of appropriate evaluation methods, and, in this manner, the combustion chamber pressure characteristic of this cylinder is reconstructed from the measured acoustic signal. Then, for example, the combustion position is determined from the reconstructed combustion chamber pressure characteristic, as described in German Patent No. 43 41 796. Furthermore, as described in detail in German Patent No. 40 02 228, the phase angle can be determined on the basis of the reconstructed combustion chamber pressure characteristic and via the comparison with a threshold value. Ultimately, a misfiring recognition and an irregular running recognition can be provided hn the evaluation unit on the basis of the combustion chamber pressure characteristic. The quantities for phase angle, irregular running, misfiring recognition, and combustion position determined in this manner are then output as manipulated variables 16 to a control unit 17, so that in control unit 17, the different control variables, for example, for the ignition are determined on the basis of the supplied manipulated variables 16 and further input variables 18, which are determined by sensors which are not shown here.

Figure 2:
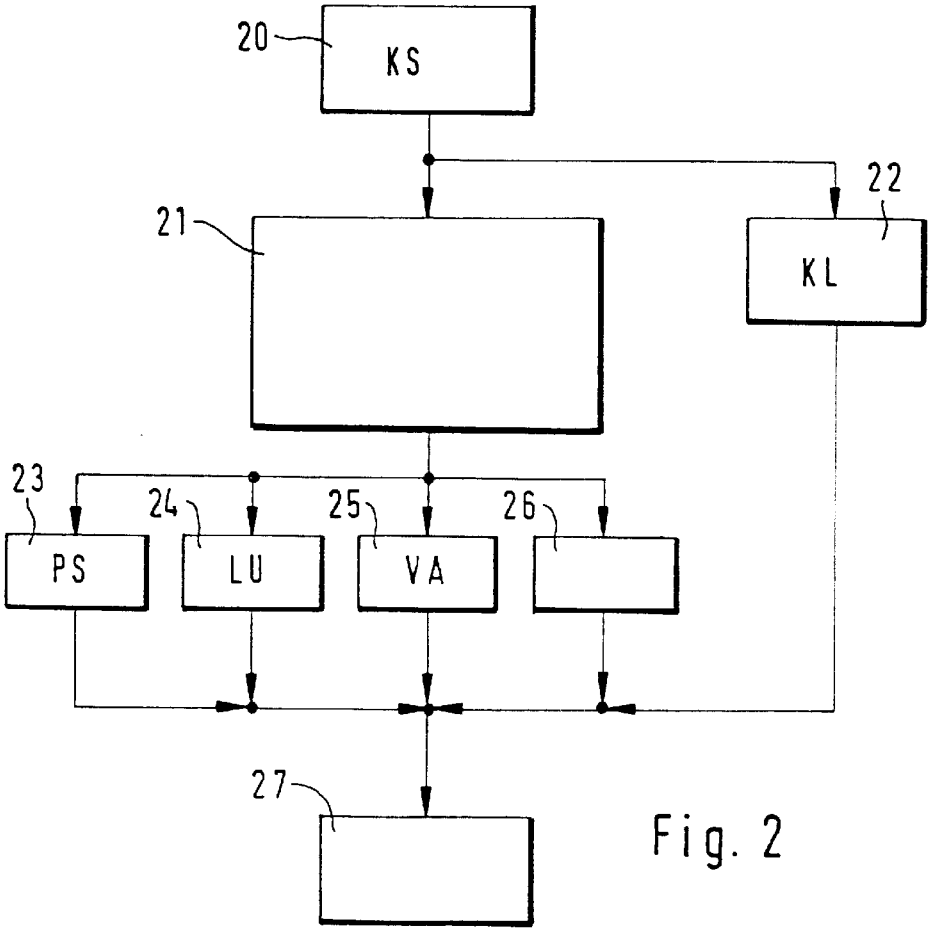
FIG. 2 shows the process steps for processing the signals of the knock sensors.

FIG. 2 shows an overview of the individual process steps. Thus, in first working step 20, knocking signal KS is acquired individually for each cylinder, and, on one hand, routed to working step 21, where the combustion chamber pressure characteristc for this cylinder is reconstructed from knocking signal KS. In a working step 22, the knocking signal is concurrently checked for knocking KL which has possibly occurred during the combustion. After the combustion chamber pressure characteristic has been reconstrusted in working step 21, an evaluation can then be carried out, alternatively either for one or for all working steps, in different working steps which are allocated parallel to each other. In this context, the phase signal is determined in a working step 23, the irregular running in a working step 24, combustion misses in a working step 25, and the combustion position in a working step 26. The outputs of these working steps 23 through 26 as well as the output of the knocking recognition circuit 22 are then fed to a working step 27 for controlling and regulating the following combustion.

What is claimed is:

1. A method for controlling a combustion in a combustion chamber of an internal combustion engine, comprising the steps of:

detecting, with at least one knock sensor, a cylinder-specific knocking signal for each cylinder of the internal combustion engine;

transmitting the detected knocking signal to an evaluation circuit;

reconstructing, in the evaluation circuit, a combustion chamber pressure characteristic as a function of the detected knocking signal; and evaluating the reconstructed combustion chamber pressure characteristic for controlling a next combustion in the cylinder.

2. The method according to claim 1, wherein the reconstructed combustion chamber pressure characteristic is evaluated for determining a phase angle.

3. The method according to claim 1, wherein the reconstructed combustion chamber pressure characteristic is evaluated for determining an irregular running.

4. The method according to claim 1, wherein the reconstructed combustion chamber pressure characteristic is evaluated for recognizing a misfiring.

5. The method according to claim 1, wherein the reconstructed combustion chamber pressure characteristic is evaluated for determining a combustion position.

* * * * *